United States Patent [19]

Takami et al.

[11] Patent Number: 4,909,715

[45] Date of Patent: Mar. 20, 1990

[54] ROTATING TYPE INTAKE AND DISCHARGE APPARATUS

[75] Inventors: Akira Takami; Toshiyuki Takahara, both of Himeji, Japan

[73] Assignee: Mitsubishi Denki Kabushiki Kaisha, Tokyo, Japan

[21] Appl. No.: 275,998

[22] Filed: Nov. 25, 1988

[30] Foreign Application Priority Data

Nov. 25, 1987 [JP] Japan ..... 62-298152
Apr. 25, 1988 [JP] Japan ..... 63-101719

[51] Int. Cl.[4] ..... F01C 1/113; F01C 17/02
[52] U.S. Cl. ..... 418/170
[58] Field of Search ..... 418/169, 170, 166, 171, 418/58, 61.1, 225; 417/273; 91/491

[56] References Cited

U.S. PATENT DOCUMENTS

| | | | |
|---|---|---|---|
| Re. 25,801 | 6/1965 | Noren | 418/169 |
| 1,166,999 | 1/1916 | Loftus | 418/166 |
| 3,241,745 | 3/1966 | Williams | 418/170 |
| 3,548,789 | 12/1970 | Creek | 418/170 |
| 3,679,334 | 7/1972 | Keldrauk | 418/170 |
| 3,810,721 | 5/1974 | Eyer | 418/170 |

FOREIGN PATENT DOCUMENTS

| | | | |
|---|---|---|---|
| 2622145 | 6/1977 | Fed. Rep. of Germany | 418/170 |
| 3144572 | 5/1983 | Fed. Rep. of Germany | 418/166 |
| 52-246 | 1/1977 | Japan . | |
| 62-46744 | 10/1987 | Japan . | |
| 62-57835 | 12/1987 | Japan . | |

*Primary Examiner*—John J. Vrablik
*Attorney, Agent, or Firm*—Sughrue, Mion, Zinn, Macpeak & Seas

[57] ABSTRACT

A rotating type intake and discharge apparatus comprises an annular rotary cylinder which is provided with a plurality of cylinder slits formed at its inner circumferential portion in the radial direction and is disposed in a housing so as to be rotatable on a first imaginary cycle, a rotary piston rotatably supported in and by the housing, which comprises piston rollers in the number one-half of that of the cylinder slits, which are arranged on a second imaginary circle having a diameter one-half as large as the first imaginary circle and in internally contact with the same and a center roller disposed near the piston rollers, the piston rollers being capable of revolving on the second imaginary circle; a flow path wall formed by a part of the housing so as to have a side plane which has the same common center as the first imaginary circle and extends along the inner side of the locus of rotation of the rotary cylinder, and a side plane which has the same common center as the second imaginary circle and extends along the outer side of the locus of rotation of the rotary piston; and a pair of intake and discharge ports formed in the housing.

8 Claims, 13 Drawing Sheets

ROTATING TYPE INTAKE AND DISCHARGE APPARATUS

BACKGROUND OF THE INVENTION

1. FIELD OF THE INVENTION

The present invention relates to a rotating type intake and discharge apparatus applicable to various kinds of gas compressors, liquid pumps, and internal or external combustion engines.

2. DISCUSSION OF BACKGROUND

FIGS. 16 -18 show conventional rotating type intake and discharge apparatuses. Specifically, FIG. 16 concerns a vane type apparatus having such construction that the inner wall 502 of a housing is formed with eccentricity to the axis of rotation 501 so that a surface area surrounded by an outer wall 503 of a rotor, vanes 504, and the inner wall 502 periodically is increased or decreased when the rotor is rotated.

FIG. 17 shows a rotating type intake and discharge apparatus of a non-circular rotor type having a construction that a rotor 601 moves on the locus of a curved line which deflects from the same center of a circle as the axis of rotation 603 in accordance with a fixed cyclic motion in a housing 602 while they are always in contact at least at three portions, and a surface area defined by an outer wall 604 of the rotor 601 and the inner wall 605 of the housing periodically is increased or decreased when the rotor is rotated.

FIG. 18 is a conventional rotating type intake and discharge apparatus of a scroll type having a construction that a rotating scroll 703 effecting an orbiting movement along a predetermined locus of revolution around an axis of revolution 701 with respect to a stationary scroll 702, and a surface area, b or f, defined by the stationary scroll 702 and the orbiting scroll 703 periodically is increased or decreased during the revolution of the orbiting scroll to the stationary scroll. Thus, the above-mentioned conventional rotating type intake and discharge apparatuses are provided with one of, or a combination of, the structural elements for effecting an intake and discharge function: including an eccentrical shape with respect to the axis of rotation, an eccentrical rotation, a non-circular rotating element having the axis of rotation deflected from that of the associated element, and an element for an orbital movement.

The conventional apparatuses having the construction described above have several problems, however. Namely, the eccentric rotation type has a problem in that friction caused between rotating elements should be minimized. For an apparatus having a non-circular rotary element, it is difficult to form the non-circular rotary element, by machining, with high accuracy. Thus, the conventional apparatuses have pushed up manufacturing costs because highly skillful techniques have been required to, for example, minimize leakage of a fluid contained therein.

SUMMARY OF THE INVENTION

It is an object of the present invention to provide a rotating-type intake and discharge apparatus with a low manufacturing cost capable of a high performance without necessitating a highly skillful technique.

The foregoing and other objects of the present invention have been attained by providing a rotating-type intake and discharge apparatus which comprises an annular rotary cylinder which is provided with a plurality of cylinder slits formed at its inner circumferential portion in the radial direction, and is disposed in a housing so as to be rotatable on a first imaginary circle; a rotary piston rotatably supported in and by the housing, which comprises piston rollers which number one half of that of the cylinder slits, which are arranged on a second imaginary circle having a diameter one half as large as the first imaginary circle and in contact internally with the first imaginary circle and a center roller disposed near the piston rollers, the piston rollers being capable of revolving on the second imaginary circle; a flow path wall formed by a part of the housing so as to have a side plane which has the same common center as the first imaginary circle and extends along the inner side of the locus of rotation of the rotary cylinder, and a side plane which has the same common center as the second imaginary circle and extends along the outer side of the locus of rotation of the rotary piston, and a pair of intake and discharge ports formed in the housing so as to be at both positions with respect to a contact point of the first and second imaginary circles in the circumferential direction, whereby intaking and discharging functions are effected by sequential engagement and removal of the piston rollers to the cylinder slits during a mutual rotation of the rotary cylinder and the rotary piston.

BRIEF DESCRIPTION OF THE DRAWINGS

A more complete appreciation of the invention and many of the advantages thereof will be obtained readily as the same becomes better understood by reference to the following detailed description when considered in connection with the accompanying drawings, wherein.

DETAILED DESCRIPTION OF THE PREFERRED EMBODIMENTS

Figure 1:
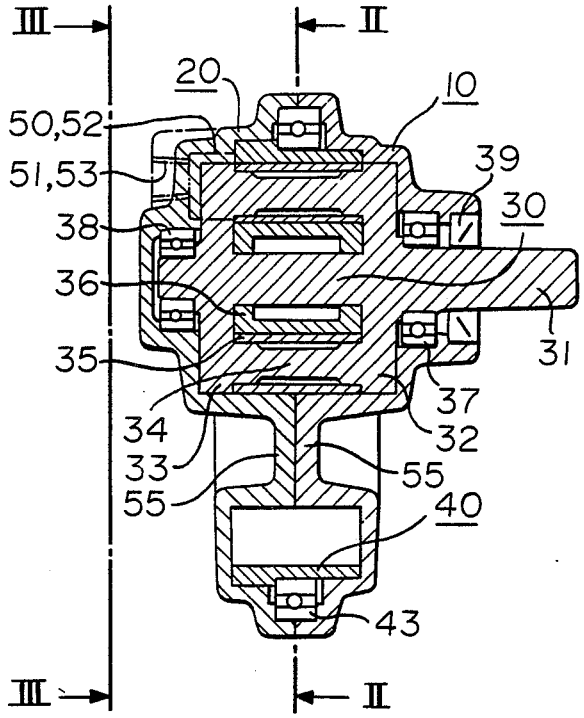
FIG. 1 is a cross-sectional view taken along a line I—I in FIG. 2, of the first embodiment of the rotating-type intake and discharge apparatus according to the present invention.

Referring to the drawings, wherein in the same reference numerals designate the same or corresponding parts throughout the several views, and more particularly to FIGS. 1–5 thereof, there are shown cross-sectional views and a side view of an embodiment of the rotating-type intake and discharge apparatus of the present invention. In FIGS. 1–5, a front housing, 10 and a rear housing 20 associated with the front housing 10 constitute a housing assembly of the apparatus. A rotary piston 30 is constituted by several elements including a driving shaft 31 so as to be rotatable. Namely, the driving shaft 31 is passed through the front housing 10 from the outside to extend to the portion near the rear housing 20. A pair of piston end plates 32, 33 are fixed on the driving shaft 31, and are contained in the front and rear housings 10, 20. A plurality of (six in this embodiment) roller pins or planetary pins, 34 are arranged between both piston end plates 32, 33 at positions on an imaginary circle having the same axial center as the driving shaft 31. Each piston roller 35 is supported rotatably by each of the roller pins 34. A center roller 36 is supported rotatably by an extension of the driving shaft 31 and is between both piston end plates 32, 33 so that the outer circumferential portion of the center roller 36 closely adjoins the outer circumferential portion of each of the piston rollers 35 with a slight gap. The rotary piston 30 having the construction described above is supported rotatably by the front housing 10 and the rear housing 20 by bearings 37, 38. Numeral 39 designates a sealing member.

A rotary cylinder 40 also is supported rotatably by the front housing 10 and the rear housing 20 by the bearing 43. The rotary cylinder 40 is in a form of a ring, and is provided with radially and inwardly formed cylinder slits 41 and partition wall portions 42 which number twice the amount of the piston rollers 35. The axial center of the driving shaft 31 is deflected from the center of the rotary cylinder 40. A numeral 50 designates an intake communication passage provided in the rear housing 20. A numeral 51 designates an intake port having a threaded portion for connecting a nipple. A numeral 52 designates a discharge communication passage provided in the rear housing 20 and numeral 53 designates a discharge port. A numeral 54 designates bolts for connecting the front housing 10 to the rear housing 20. A numeral 55 designates a flow path wall formed by parts of the front and rear housings 10, 20 to provide a continuous plane.

Figure 2:
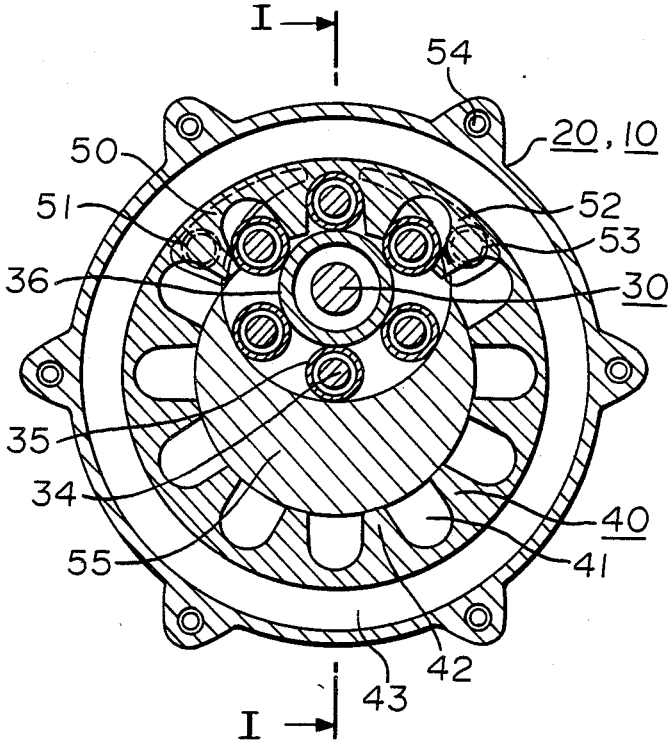
FIG. 2 is a cross-sectional view taken along a line II—II in FIG. 1.
Figure 6:
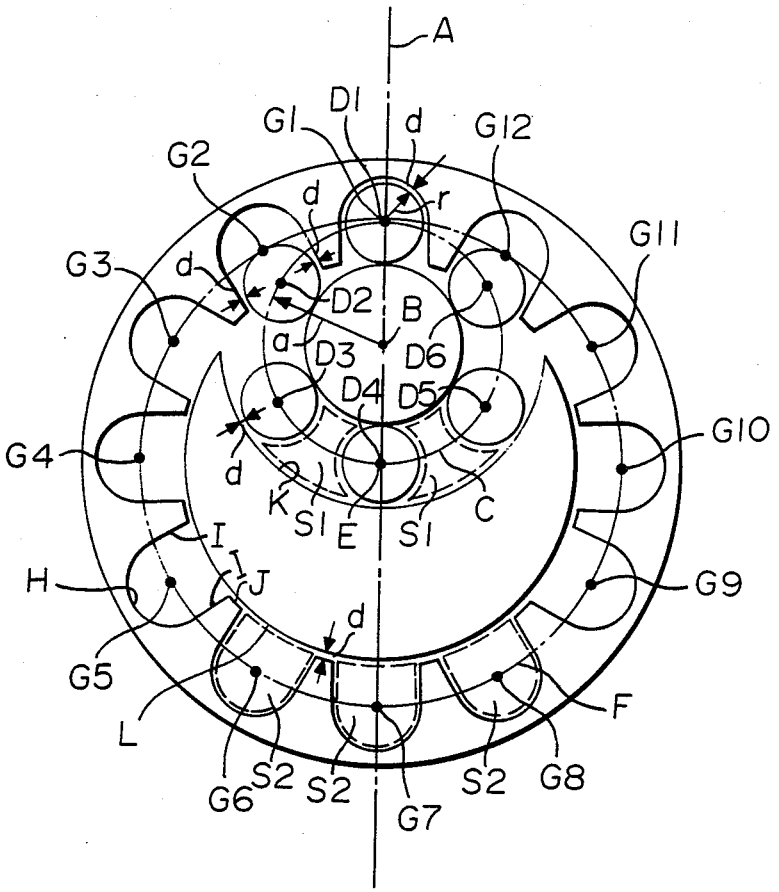
FIG. 6 is a diagram for illustrating the function of intake and discharge in the apparatus of the present invention.
Figure 7:
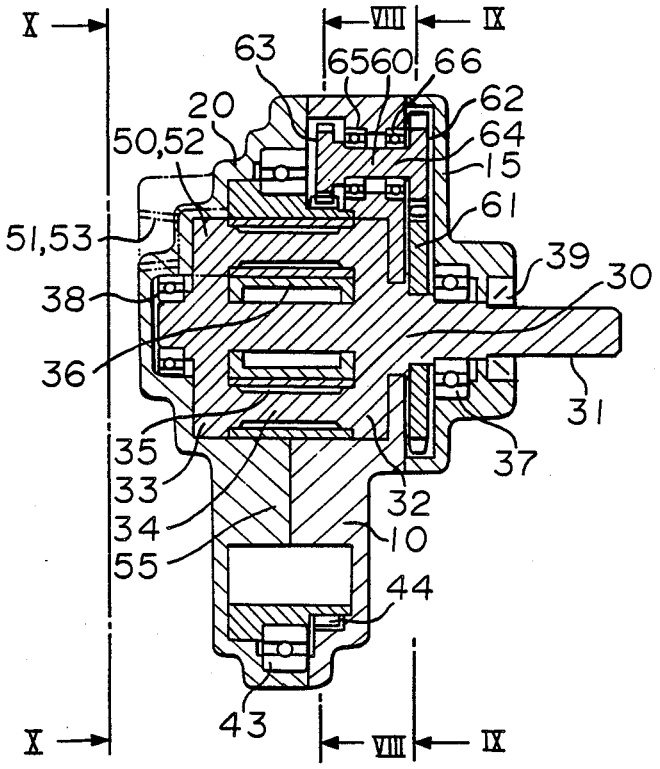
FIG. 7 is a cross-sectional view of a second embodiment of the invention taken along a line VII—VII in FIG. 8.
Figure 8:
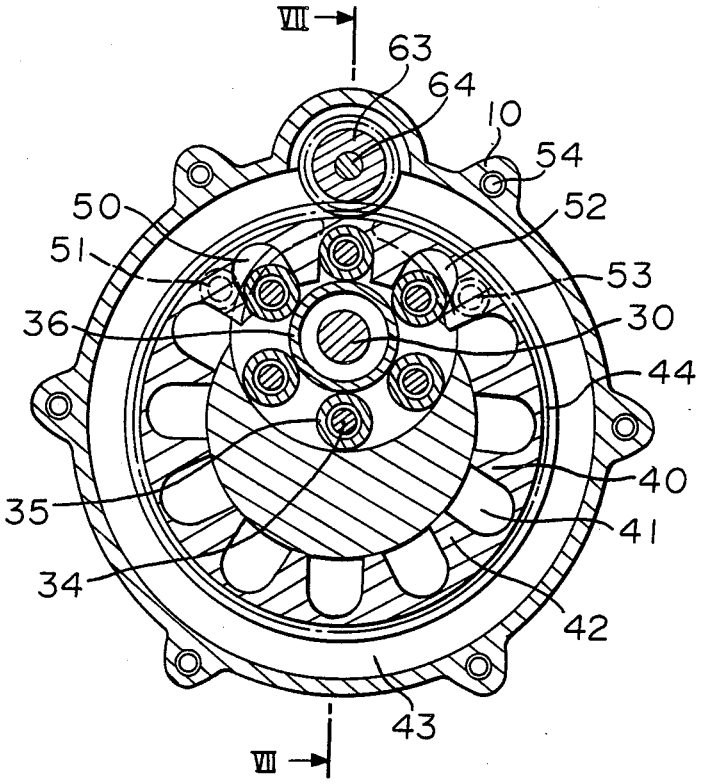
FIG. 8 is a cross-sectional view, taken along a line VIII—VIII in FIG. 7.
Figure 9:
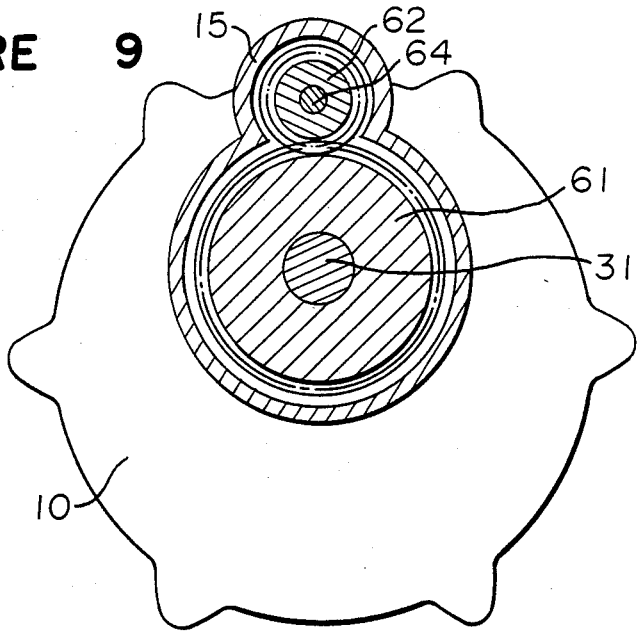
FIG. 9 is a cross-sectional view taken along a line IX—IX in FIG. 7.
Figure 10:
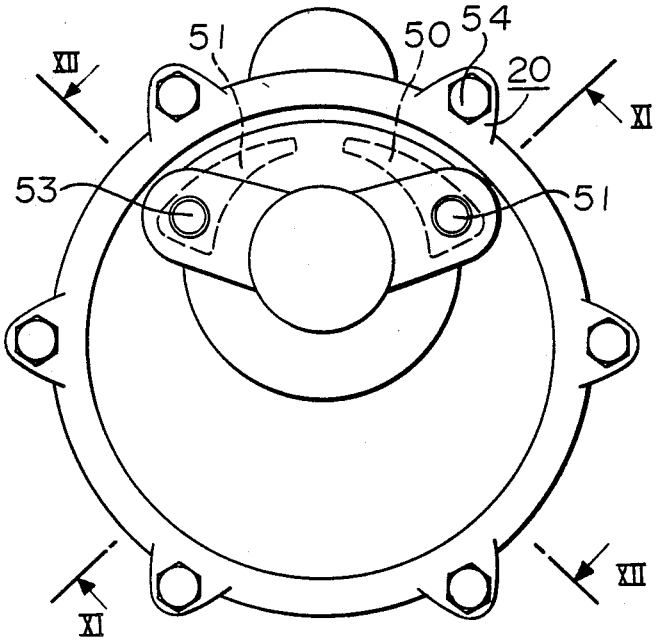
FIG. 10 is a side view viewed from a line X—X in FIG. 7.
Figure 11:
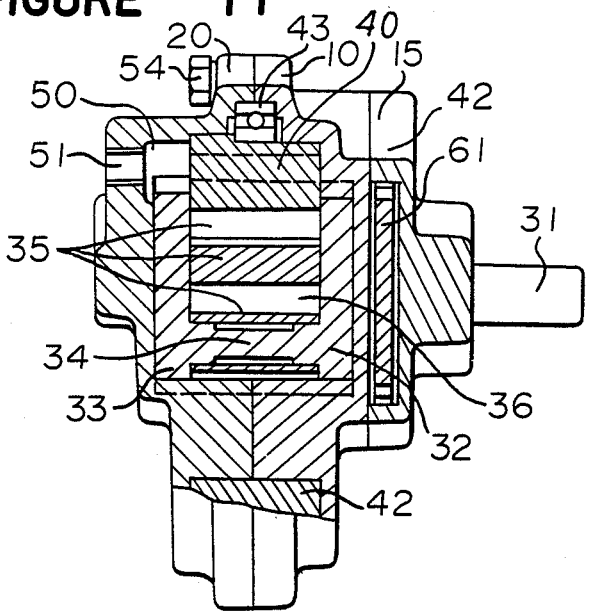
FIG. 11 is a cross-sectional view taken along a line XI—XI in FIG. 10.
Figure 12:
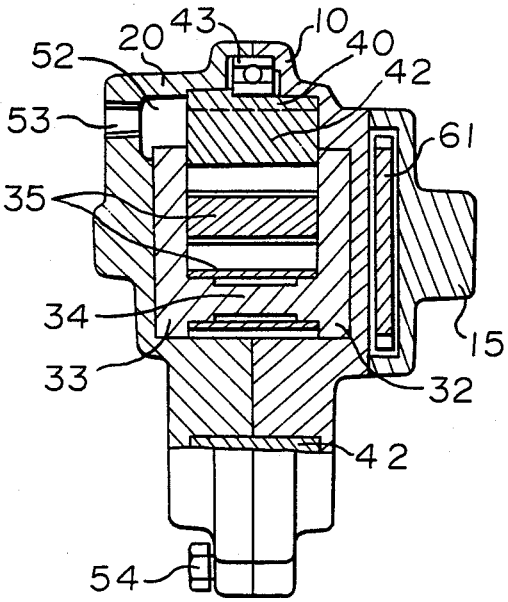
FIG. 12 is a cross-sectional view taken along a line XII—XII in FIG. 10.

FIG. 6 is a diagram showing the same plane as that cross-sectioned in FIG. 2 in which only elements directly related to the intaking and discharging functions are highlighted. With FIG. 6 more detailed description will be made.

In FIG. 6, a symbol A designates a linear line drawn optionally, and a symbol B designates a point indicating the center of rotation of the rotary piston 30, which is located on the linear line A. A symbol a represents the radius of an imaginary cylinder on the rotary piston 30, on which is located each of the centers of roller pins 34. A symbol C represents a second imaginary circle drawn around the point B with a radius a. Symbols $D_1$ through $D_6$ represent points at which each of the centers of the piston rollers 35 are located as a reference position. A symbol r represents the outer radius of each of the piston rollers 35. A symbol E indicates a crossing point between the linear line A and the circle C, and which is the center of rotation of the rotary cylinder 40. A symbol F represents a first imaginary circle having its center E and a radius *2a*. Symbols $G_1$ through $G_{12}$ on the circle F indicate points showing the locations of the cylinder slits 41 in the same reference position as the piston rollers 35. Each of the cylinder slits 41 is surrounded by a semicircular portion indicated by a symbol H which has any one of the points $G_1$ through $G_{12}$ as its center, and two linear lines I which are parallel to an imaginary linear line formed by connecting the point $G_1$ ($G_2$. . . $G_{12}$) to the point of center E. A symbol J represents a part of the partition wall portion 42 of the rotary cylinder 40 in the form of part of a cylindrical shape formed around the center E. A symbol L represents a circular arc corresponding to a part of a cylindrical shape which forms the flow path wall 55, the circular arc being drawn by a radius *2a*–r around the center E. A symbol K represents a circular arc corresponding to a part of the other cylindrical shape which forms the flow path wall 55, the circular arc having a radius a+r+d (d: a value indicative of a gap) around the center B. The gap d is provided respectively between the semicircular portion H and the outer diameter of the piston roller 35; between the linear line I and the outer diameter of the piston roller 35; between the circular arc portion K and the outer diameter of the piston roller 36, and between the circular arc portion L and the circular arc portion J.

Although the detailed illustration is not given in FIG. 6, construction is performed as that a gap d is produced between the circular arc portion J and the center roller 36 even when the circular arc portion J is overlapped with the linear line A so that the circular arc portion J is at the closest position to the outer circumferential surface of the center roller 36.

The operation of the rotating-type intake and discharge apparatus having the above-mentioned construction will be described hereinbelow.

When the driving shaft 31 is driven, a revolution of the piston rollers 35 on the circle C is effected (FIG. 6). During the revolution of the piston rollers 35, at least one piston roller 35 is in contact with the plane indicated by the linear line I of the cylinder slit 41 thereby to drive the rotary cylinder 40. The piston roller 35 which is located at the point $D_1$ takes the deepest position in the cylinder slit 41 which is located at the point $G_1$. The point $D_1$ and the point $G_1$ are on the linear line A.

When the rotary piston 30 is rotated by 1/6 of the circumference of circle C in the counterclockwise direction from the position shown in FIG. 6, the point $D_1$ is moved to the point $D_2$, during which the rotary cylinder 40 is rotated by 1/12 in the counterclockwise direction, whereby the point $G_1$ is moved to the point $G_2$. Since the ratio of the radius of the circle C to that of the circle F is 1:2, the length of all circular arcs on the circle C, such as $D_1$ $D_2$, $D_3$ $D_4$, and so on, are respectively equal to those on the circle F such as $G_1$ $G_2$, $G_2$ $G_3$, and so on. Accordingly, when the point $D_1$ is moved around on the circle C to be returned to the original position on the linear line A, it is overlapped with the point $G_7$ which is moved on the circle F by the length of the semicircle.

When a relative movement, as described above, is shown in a geometrical manner in FIG. 6, a hypocycloid curve is obtained in which the circle C is in contact with, and rolls on, the circle F. In the present invention, the ratio of the radius of the circle C to that of the circle F is determined to be 1:2 in order to utilize a state that the hypocycloid curve becomes a linear line portion.

When the rotary piston 30 is rotated continuously in the counterclockwise direction, the piston rollers 35 are moved continuously in the annular groove formed by the outer circumference of the center roller 36 and the circular arc K from the left side of the linear line A toward the right side. Then, spatial areas $S_1$ surrounded by broken lines which reflect a predetermined distance and are between two piston rollers 35, are moved continuously from the left side of the linear line A toward the right side. The speed of rotary cylinder 40, rotated continuously in the counterclockwise direction, is one half of that of the rotary piston 30, and spatial areas $S_2$, defined by broken lines including the circular arc L which is in the cylinder slits 41, are moved continuously from the left side of the linear line A toward the right side along the outside of the circular arc L. When two piston rollers 35, between which the spatial area $S_1$ is formed are moved from the right side of the linear line A to the left side via the portion at which the circle C comes in contact with the circle F, substantially the entire portion of the spatial area $S_1$ is filled because the partition wall portion 42 enters the space formed between the piston rollers 35. Also, when the cylinder slits 41, which cause the spatial areas $S_2$ to move, are moved from the right side of the linear line A toward the left side via the portion at which the circle C comes in contact with the circle F, piston rollers 35 enter into the cylinder slits 41, whereby the spatial areas $S_2$ are filled by at least the cylindrical bodies having the radius r. Thus, referring to FIG. 6, when the rotary piston 30 is rotated, continuously the spatial areas $S_1$ and $S_2$ move continuously from the left side of the linear line A toward the right side.

Figure 3:
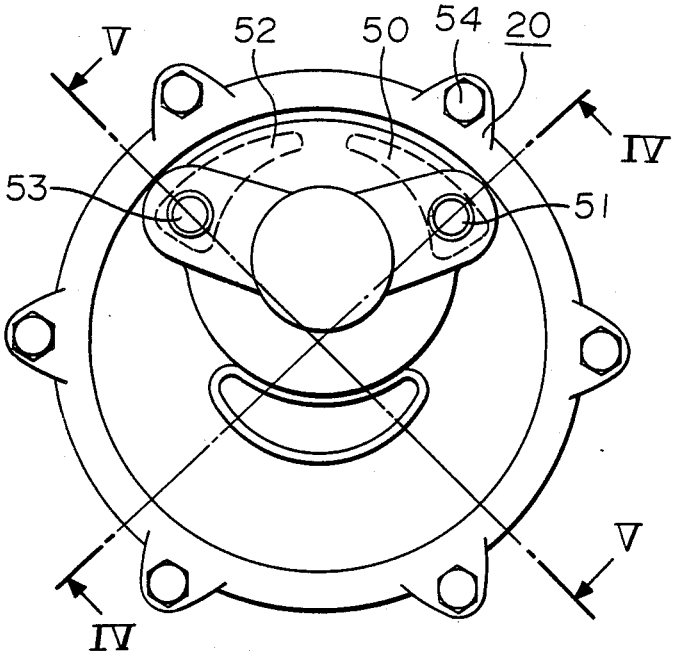
FIG. 3 is a side view viewed from a line III—III in FIG. 1.

In the apparatus as shown in FIG. 1, spatial capacities move continuously from the side at which an intake port 51 is formed to the side in which a discharge port 53 is formed (as shown in FIGS. 2 and 3), with respect to a plane as a boundary which is parallel to the driving shaft, and which includes the linear line shown in FIG. 6. When the side at which the intake port 51 is formed is referred to as an intake side space, and the side at which the discharge port 53 is formed is referred to as a discharge side space, the intake side space communicates with an intake port 51 through an intake communication passage 50 and the discharge side space communicates with a discharge port 53 through a discharge communication passage 52 as shown in FIG. 2.

Figure 4:
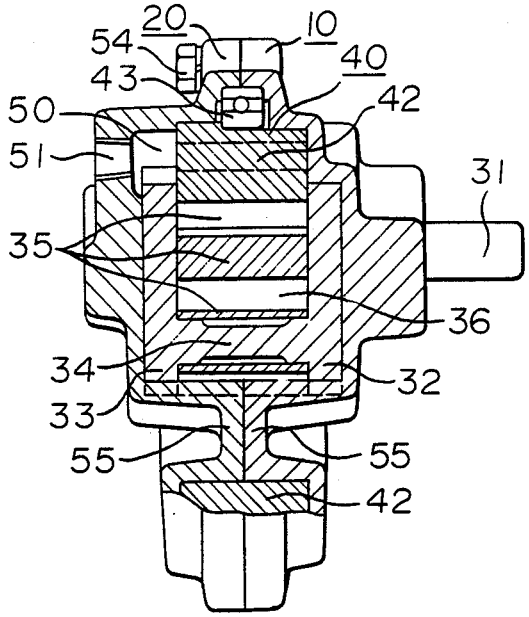
FIG. 4 is a cross-sectional view taken along a line IV—IV in FIG. 3.
Figure 5:
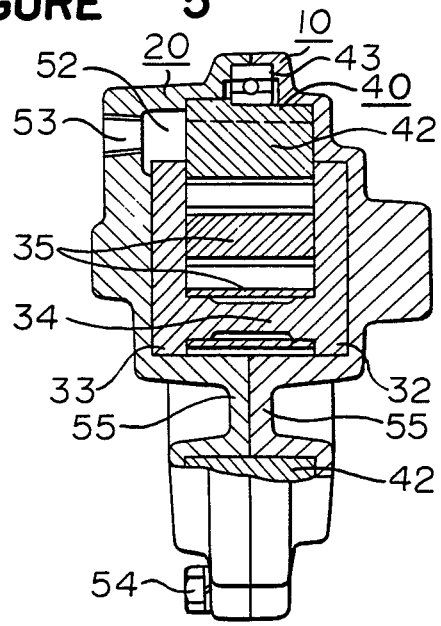
FIG. 5 is a cross-sectional view taken along a line V—V in FIG. 3.

As shown in FIGS. 3 through 5 in more detail, the intake port 51 and the discharge port 53 constitute communication ports with the outside of the apparatus. Thus, the rotating-type intake and discharge apparatus of the present invention is provided with intake and discharge functions to effect continuous movement of spatial capacities from the intake port 51 to the discharge port 53.

Hereinbelow, description will be made as to another feature of the apparatus according to the present invention. In the rotating-type intake and discharge apparatus of the present invention, moving elements belong either to the rotary piston or the rotary cylinder. Major moving elements which greatly affect an inertia of rotation are driven continuously in accordance with a fixed rotating speed ratio of the driving shaft. The piston rollers and the cylinder slits which constitute the working elements for effecting the intaking and discharging functions open and close the spatial capacities regularly with a high efficiency while they effect a stable movement of rotation by receiving a smooth driving force. Further, power for the opening and closing functions performed by not only a single set of piston rollers and the cylinder slits but also by plural sets of the piston rollers and the cylinder slits, is generally flat at every position of the driving shaft during rotation.

The piston rollers and the cylinder slits are moved relatively to each other so that the rollers come closer to, or in contact with, the inner wall of the cylinder slits and the inner wall of the housing. Sliding movement of these moving elements is characterized by a non-contact sliding movement in which a minute gap is formed therebetween, or a rolling-contact movement. Thus, operations result in a high power conversion efficiency without a substantial loss due to a friction. This feature can be realized by a structure consisting of the rotary piston and the rotary cylinder which causes a relative movement according to a hypocycloid curve which is obtained by two circles, one inside the other, having a radius ratio of 1:2.

The intake and discharge apparatus of the present invention having a high power conversion efficiency is applicable not only to high performance pumps for various kinds of fluid, but also to hydromotors driven by a pressurized fluid. Since the apparatus of the present invention provides good power conversion efficiency, it can be used for a mechanical power transmission system such as a continuous stepless conversion apparatus which changes a rotational speed or torque. Further, it can be used for a rotary type internal or external combustion engine by properly adjusting an intake and discharging timing.

In the embodiment shown in FIGS. 1 through 6, six piston rollers are used. However, the number of the piston rollers is not critical to the rotating type intake and discharge apparatus of the present invention, and a greater number of piston rollers can be used. In the apparatus of the present invention, the number of piston rollers is related to the characteristics of the intake and discharge functions. Accordingly, the number of piston rollers can be reduced when the intake and discharge apparatus of a low pressure and large flow rate-type is used. The number of piston rollers may be increased when an apparatus of a small flow rate and high pressure, type is used. Thus, the apparatus can be used for a broad range of pressure and flow rates.

Thus, in accordance with the embodiment described above, several effects can be obtained by arranging the rotary piston and the rotary cylinder in a specified relation as to effect a relative movement for intake and discharge functions. Namely, the moving elements in the apparatus are driven by the driving shaft to keep a dynamically smooth and stable continuous movement of rotation; additionally, the intake and discharge functions can be smooth at every position of rotation of the driving shaft, and thus a load to the driving shaft is smooth; furthermore, a loss caused by a sliding contact can be minimized since working elements performing the intake and discharge functions are subjected to a relatively non-contact movement or a rolling contact movement. Finally, the shapes of portions essential for performing the intake and discharge functions consist of flat planes and cylindrical surfaces. This increases accuracy in machining, and reduces the number of processes.

FIGS. 7 through 12 show a second embodiment of the rotating-type intake and discharge apparatus of the present invention. The same reference numerals used in FIGS. 1 through 6 designate the same or corresponding parts, and therefore, description of these parts is omitted.

Referring to FIGS. 7 through 12 a synchronizing driving unit 60 has a first gear wheel 61 firmly attached to the driving shaft 31, a second gear wheel 62 interlocked with the first gear wheel 61, a teeth portion 44 formed in the outer circumference of the rotary cylinder 40, a third gear wheel 63 interlocked with the teeth portion 44, a connecting shaft 64 connecting the second gear wheel 62 to the third gear wheels 63, and a bearing 65 supporting the connecting shaft 64.

A cover 15 is attached to the front housing 10. The driving shaft 31 extends through the front housing 10 to the rear housing 20.

The rotary piston 30 is supported by the cover 15 and the rear housing 20 by the bearings 37, 38.

In the second embodiment of the present invention, the moving elements belong to either the rotary piston 30, the rotary cylinder 40, or the synchronizing driving unit 60.

The operation of the second embodiment will be described hereinbelow.

When the driving shaft 31 is rotated, the piston rollers 35 thereby are revolved along the locus of the circle C as shown in FIG. 6, and, simultaneously a rotational force of the driving shaft 31 is transmitted to the rotary cylinder 40 by the synchronizing driving unit 60, whereby the rotary cylinder 40 is rotated at a speed one half lower than that of the rotary piston 30. The movement of the moving elements and the intake and discharge functions obtained thereafter in the second embodiment are the same as those obtained in the first embodiment described above, with reference to FIG. 6. Therefore only description on the construction and the movement related to the synchronizing driving unit 60 will be described hereinbelow.

In the second embodiment, the rotary piston 30 and the rotary cylinder 40 are rotated always at a ratio of rotating speed of 2:1, and in a correct angular relation by the synchronizing driving means 60, and piston rollers 35 keep their phase positions so as to be closer to, or in contact with, the inner wall of the cylinder slits 41. On the other hand, a relative movement of the piston rollers 35 and the inner wall of the housings occurs keeping a slight gap therebetween. The moving elements of the rotating-type intake and discharge apparatus of the present invention are always in a non-contact state or a rolling-contact state, in the same manner as described in the first embodiment. Accordingly, operations can be effected at a high power conversion efficiency without a loss due to a friction. Such an excellent feature can be obtained by effecting a movement of the rotary piston 30 and the rotary cylinder 40 along a hypocycloid curve as described in the first embodiment.

In the second embodiment, especially, the synchronizing driving unit 60 mainly functions to drive the rotary cylinder 40, and the piston rollers 35 and the cylinder slits 41 do not substantially concern a driving function, but solely perform an opening and closing function. Namely, in the second embodiment, there are two parts which perform separate functions: the synchronizing driving unit 60 which drives the rotary cylinder 40, and the piston rollers 35 and cylinder slits 41 which perform the opening and closing function. With such a construction, the rotary cylinder 40 can be rotated smoothly even when a driving force is not transmitted to the rotary cylinder 40 by the piston rollers 35 and the cylinder slits 41. The apparatus of the second embodiment is effective with large capacity type apparatus, wherein the rotary piston 30 and the rotary cylinder 40 have a small meshing rate and a small number of piston rollers.

Even when the accuracy in the positional relationship of the piston rollers 35 to the cylinder slits 41 is marginal, a smooth rotation can result by providing an appropriate clearance for the piston rollers 35. Further, gap errors between the piston rollers 35 and the cylinder slits 41 in the direction of the rotation and the opposite side can be averaged. Accordingly, engagement of the piston rollers 35 with the cylinder slits 41 and the removal of the piston rollers 35 from the cylinder slits 41 smooth even when the dimensions of the gaps d are reduced further. Accordingly, the amount of fluid leaked can be reduced to thereby further improve power conversion efficiency.

For the synchronizing driving unit 60 a different mechanism can be replaced as long as it has a function to provide a ratio of 2:1 for rotating speed of the rotary piston 30 to the rotating speed of the rotary cylinder 40.

Figure 13:
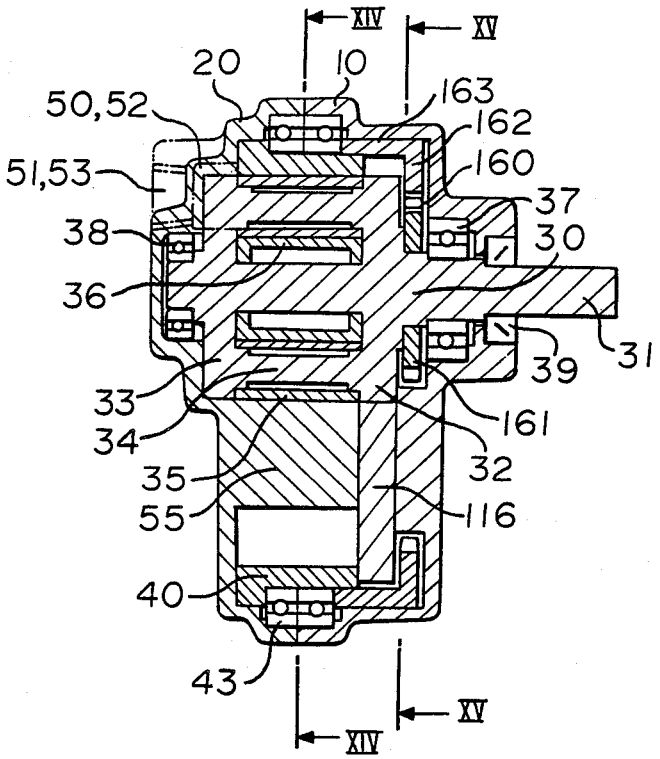
FIG. 13 is a cross-sectional view of a further embodiment of the invention taken along a line XIII—XIII in FIG. 14.
Figure 14:
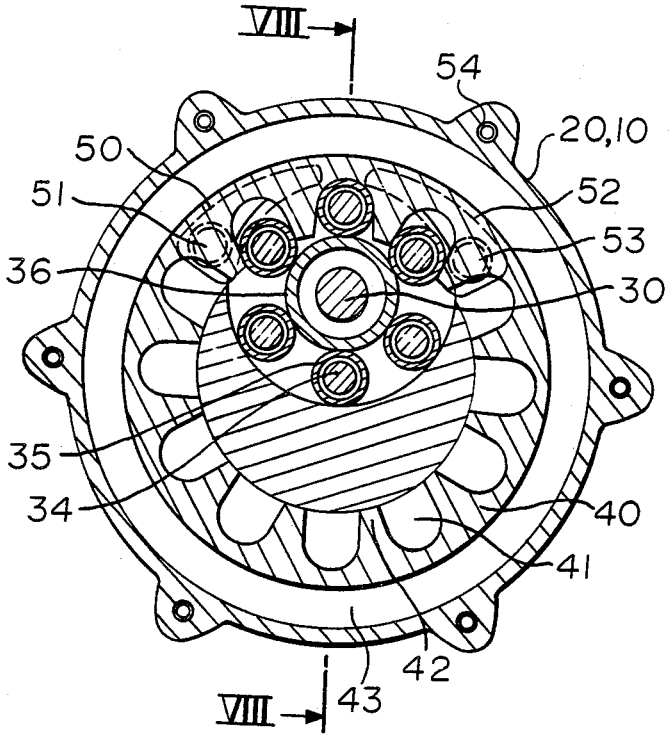
FIG. 14 is a cross-sectional view taken along a line XIV—XIV in FIG. 13.
Figure 15:
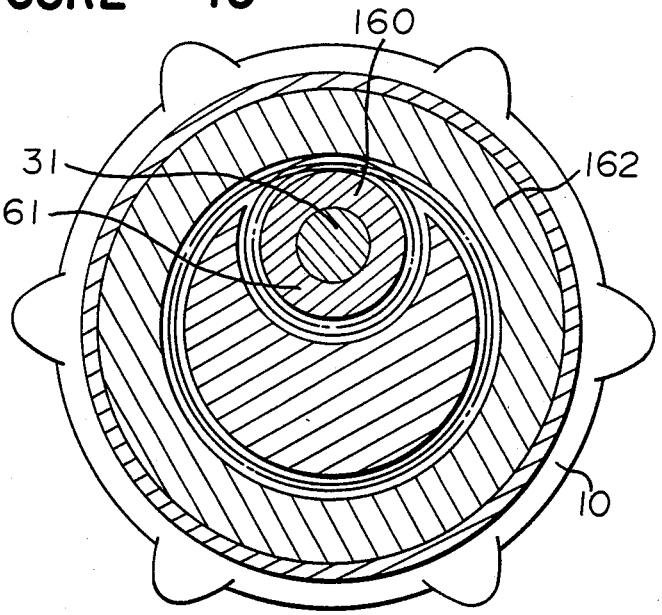
FIG. 15 is a cross-sectional view taken along a line XV—XV in FIG. 13.
Figure 16:
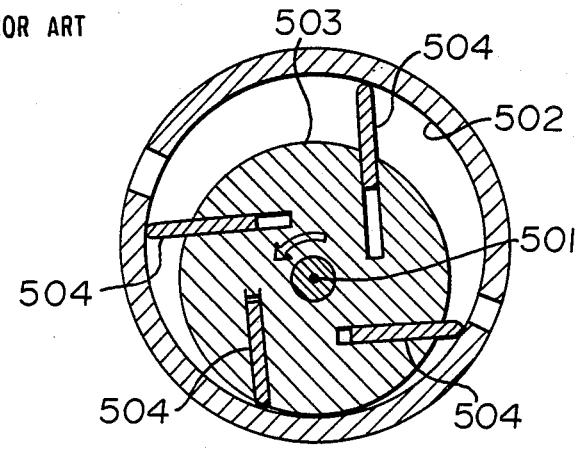
FIGURE 16 PRIOR ART
FIGS. 16 through 18 are shown conventional rotating-type intake and discharge apparatuses of different types.
Figure 17:
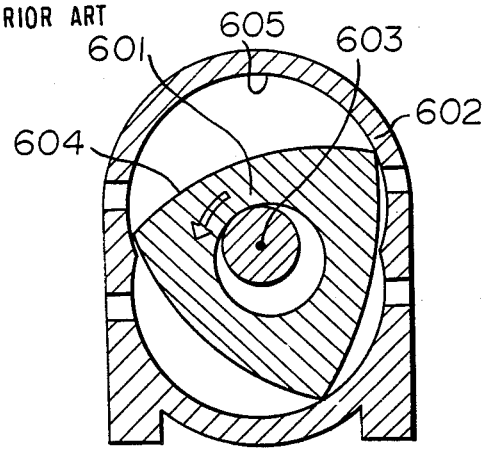
FIGURE 17 PRIOR ART
Figure 18:
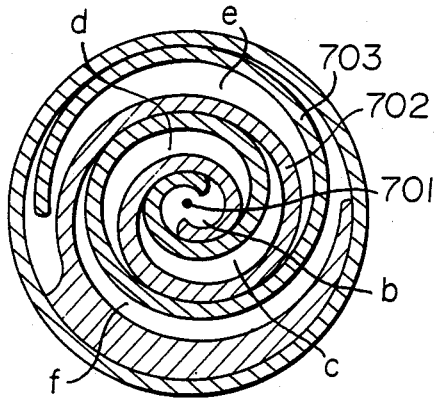
FIGURE 18 PRIOR ART

FIGS. 13 through 15 show a modified embodiment of the second embodiment of the present invention, and have the same reference numerals as in FIGS. 7 through 12 designate the same or corresponding parts, and therefore description of these parts is omitted.

A synchronizing driving unit 160 used for the modified embodiment comprises a first gear wheel 161 firmly attached to the driving shaft 31, and an internal gear wheel 162 firmly attached to the outer peripheral portion of the rotary cylinder 40 by a boss 163. The radius of pitch circle of each gear wheel 161 and the internal gear wheel 162 is given respectively by a value a and a value *2a*, and the ratio of the rotating speed of the rotary piston 30 to that of the rotary cylinder 40 is kept at 2:1 as in the second embodiment.

The housing assembly comprises the front housing 10, the rear housing 20, and a fixed block 116 which is fixed to the front housing 10 or the rear housing 20. The basic construction other than that described above is the same as that described in the second embodiment. Accordingly, the function of the modified embodiment is the same as that of the second embodiment.

Description has been made as to the synchronizing driving unit comprising gear wheels. Alternatively, a friction transmitting mechanism can be used for the gear wheel mechanism to overcome the problem of slipping at the power transmitting part.

In the second embodiment and the modification thereof, in addition to the effect obtainable in the first embodiment of the present invention, an amount of fluid leaked can be reduced thereby to improve efficiency since the movement of the rotary piston and the rotary cylinder can be performed at a correct angular position by a synchronizing driving unit. Further, a smooth operation can be maintained even though accuracy in the positional relationship between the piston rollers and the cylinder slits is relatively poor.

Obviously, numerous modifications and variations of the present invention are possible in light of the above teachings. Therefore is to be understood that within the scope of the appended claims, the invention may be practiced otherwise than as specifically described herein.

What is claimed is:

1. A rotating-type intake and discharge apparatus which comprises:

an annular rotary cylinder which is provided with a plurality of cylinder slits formed at its inner circumferential portion in the radial direction and is disposed in a housing so as to be rotatable on a first imaginary circle;

a rotary piston rotatably supported in and by said housing, which comprises piston rollers which number one half of the number of said cylinder slits, said piston rollers being arranged on a second imaginary circle having a diameter one half as large as said first imaginary circle and in contact with an inner circumference of said first imaginary circle, and a center roller disposed near said piston rollers, said piston rollers being capable of revolving on said second imaginary circle;

a flow path wall formed by a portion of said housing so as to have a first arcuate portion which has a common center with said first imaginary circle and which extends inside said first imaginary circle, and a second arcuate portion which has a common center with said second imaginary circle and which extends outside said second imaginary circle; and a pair of intake and discharge ports formed in said housing so as to be at both an intake position and a discharge position with respect to a contact point of said first and second imaginary circles in a circumferential direction, whereby intaking and discharging functions are effected by sequential engagement and removal of said piston rollers by said cylinder slits during a mutual rotation of said rotary cylinder and said rotary piston.

2. The rotating-type intake and discharge apparatus according to claim 1, wherein said first and second arcuate portions are joined at respective ends thereof so as to define a crescent surface area.

3. The rotating-type intake and discharge apparatus according to claim 1, wherein said center roller is rotatably supported by the extension of a driving shaft between a first and second end plate of said rotary piston which are firmly attached to the driving shaft, the driving shaft being rotatably supported by said housing at an eccentrical position with respect to said rotary cylinder.

4. The rotating-type intake and discharge apparatus according to claim 1, wherein a slight gap is formed between said piston rollers and said flow path wall, between said piston rollers and said cylinder slits, and between said rotary cylinder and said flow path wall.

5. The rotating-type intake and discharge apparatus according to claim 1, which further comprises a synchronizing driving mechanism for transmitting a driving force so that a ratio of rotational speed of said rotary cylinder to said rotary piston is 1:2.

6. The rotating-type intake and discharge apparatus according to claim 5, wherein said first and second arcuate portions are joined at respective ends thereof so as to define a crescent surface area.

7. The rotating-type intake and discharge apparatus according to claim 5, wherein said center roller is rotatably supported by the extension of a driving shaft between a first and second end plate of said piston which are firmly attached to the driving shaft, the driving shaft being rotatably supported by said housing at an eccentrical position with respect to said rotary cylinder.

8. The rotating-type intake and discharge apparatus according to claim 5, wherein a slight gap is formed between said piston rollers and said flow path wall, between said piston rollers and said cylinder slits, and between said rotary cylinder and said flow path wall.

* * * * *